United States Patent [19]

Smith et al.

[11] Patent Number: 4,977,006

[45] Date of Patent: Dec. 11, 1990

[54] ADHESIVE LABELS AND METHODS FOR THEIR MANUFACTURE

[75] Inventors: Hylton H. Smith, Prudhoe; Richard G. Foggin, Newcastle, both of Great Britain

[73] Assignee: Revolutionary Adhesive Materials, Ltd., Gateshead, England

[21] Appl. No.: 383,764

[22] Filed: Jul. 20, 1989

[30] Foreign Application Priority Data

Jul. 20, 1988 [GB] United Kingdom ..... 8817239

[51] Int. Cl.[5] ..... B44C 00/00; D21H 00/00

[52] U.S. Cl. ..... 428/42; 156/234; 156/247; 156/273.3; 427/146; 427/265; 428/203; 428/345

[58] Field of Search ..... 428/42, 343, 345, 41, 428/352, 202, 201, 203, 204, 205, 193, 198, 914; 156/234, 247, 273.3; 427/146 O, 148, 152, 147, 265

[56] References Cited

U.S. PATENT DOCUMENTS

| | | | |
|---|---|---|---|
| 3,592,722 | 7/1971 | Morgan | 428/198 |
| 3,741,787 | 2/1973 | Tordjman | 156/234 |
| 3,936,570 | 2/1976 | Iwata | 427/148 |
| 4,219,596 | 8/1980 | Takemoto et al. | 156/231 |
| 4,253,899 | 3/1981 | Takemoto et al. . | |
| 4,313,994 | 2/1982 | Kingston | 428/352 |
| 4,454,179 | 6/1984 | Bennett et al. | 428/42 |
| 4,759,968 | 7/1977 | Janssen | 428/204 |

FOREIGN PATENT DOCUMENTS 1228858 4/1971 United Kingdom .

*Primary Examiner*—Michael W. Ball
*Assistant Examiner*—Chester T. Barry
*Attorney, Agent, or Firm*—Rodney F. Brown

[57] ABSTRACT

The present invention provides strucutures for dispensing ulra-thin adhesive labels without risk of predispensing and comprising a carrier web and a face film, the carrier web having a top and reverse side, a release surface being provided on the top side, the face film having two faces, an adhesive-backing being provided on a first of the faces, the second of the faces being mounted against the release surface and wherein the face film is frangible and the release surface positively defines at least one label-shape, the area covered by the adhesive backing corresponding substantially to at least the one label-shape.

32 Claims, 2 Drawing Sheets

ADHESIVE LABELS AND METHODS FOR THEIR MANUFACTURE

FIELD OF THE INVENTION

The present invention relates to adhesive labels, methods for their manufacture and label-dispensing structures.

BACKGROUND INFORMATION

Conventional labels are generally pressure-sensitive and usually consist of paper or plastic shapes created from sheets and spaced apart on a web by die cutting, and matrix or skeleton-stripping of the interstitial waste areas. The web (linear or carrier) typically has a release layer applied to one side and the adhesive and face (label) layer are applied to this release layer, adhesive first. The labels are identified by stripping away the skeleton of the waste face and adhesive, which also allows correct dispensing of the labels.

The facestock of such labels usually carries graphics or indicia on the exposed surface of the applied label, and may be subject to such as oxidation, scuffing and adhesion failure.

The above labels are most often referred to as "laid-on labels", and are made by die-cutting, for example as described in U.S. Pat. No's 2,391,539 and 3,166,186. These disclose a method wherein a sheet or roll of laminated construction (a layer of label facestock, a layer of pressure-sensitive adhesive and a temporary carrier web having a release surface in contact with the adhesive) provides discrete labels by die-cutting through the label facestock and adhesive layer, without cutting through the carrier web, to define the periphery of the individual labels. The facestock and adhesive surrounding the individual labels forms a continuous, skeletal web or matric which is stripped from the carrier web to leave discrete, spaced apart labels adhering to the carrier web. Printing and protective coatings are applied to any suitable stage. The precision required for cutting means that any error is likely to result in either cutting through the web or leaving the skeleton still partially attached to the labels.

Laid-on labels having an adhesive layer in contact with the release surface of a carrier web are typically dispensed in one of two ways. An individual label may be manually peeled from the carrier sheet and applied to a substrate, or the carrier web may be bent over a sharp angle, for example, by drawing the carrier across an edge, and the less flexible label becomes at least partially separated from the carrier web. The separated portion of the label may then be applied directly to a substrate or grasped manually for removal from the carrier web.

In both of the above methods of label dispensing, it is necessary that the label itself possess sufficient rigidiity and strength to survive removal from the carrier film and the transfer to a substrate. In addition, a label manually removed from the carrier web must have sufficient thickness to be readily grasped by the user.

The practice of making laid on labels by die-cutting and stripping of the matrix is wasteful of materials and requires the use and maintenance of precision die-cutting machinery.

It is possible to apply laid-on-labels to inset surfaces, but considerable error can accrue when transferring the labels from web to substrate. Two contructs attempting to avoid these problems are described in U.S. Pat. No's 4,022,926 to Keough, et al, and 4,219,596 to Takemoto et al.

Keough describes a method of printing a liquid, pressure-sensitive adhesive in the predetermined pattern of the label areas directly onto the release surface of a carrier web, leaving areas of the web uncoated by adhesive. The adhesive is solidified, and a face film of radiation-polymerisable liquid is formed over each adhesive area and solidified.

Takemoto provides a label construct comprising a temporary carrier web having a release surface with a label releasably adhered, face down, to the release surface. The labels comprise individual areas of radiation cured face film in contact with the release suface of the carrier web, with a layer of pressure-sensitive adhesive away from the carrier web. Indicia may be located between the face film and the adhesive. A backing protects the adhesive and has a release surface in contact with the adhesive, adhesion between the two being necessarily weaker than adhesion between the release surface of the temporary carrier web and the face film. The protective backing can thus be removed from the label to expose the adhesive while leaving the label releasably adhered to the carrier web. The exposed adhesive of the label is applied to a substrate and the temporary carrier web removed, leaving the label adhered to the substrate.

The above systems offer discrete label shapes but are not ideal, as accurate application relies upon the label shapes remaining in register even under tight winding of the carrier web, necessary to avoid telescoping. Both systems are subjected to predispensing of labels, or movements of labels relative to one another, which results in the loss of ability to locate labels with precision. Winding of the carrier web can also easily result in loss of register.

SUMMARY OF THE INVENTION

Thus, the present invention aims to provide label structures for storing and dispensing adhesive labels which do not require the provision and maintenance of complex precision cutting machinery.

It is also an object of the present invention to provide structures capable of dispensing discrete labels, without the labels skewing during storage.

It is another object of the invention to provide ultra-thin labels providing a 'no-label' effect.

It is a further object of the invention to provide labels capable of being applied to inset surfaces from a storage structure.

These and further aims and objects may be achieved by the invention which essentially residues in the use of a thin, flexible and frangible plastics layer to form the face film.

Thus, in a first aspect, the invention provides a label-dispensing structure comprising a carrier web and a face film, said carrier web having a release surface and said face film having two faces, said face film being adhesively-backed on a first of said faces, the second of said faces being mounted against said release surface, and wherein said face film is frangible and said release surface substantially defines at least one label-shape, the area covered by said adhesive backing correspondingly substantially to at least said one label-shape.

In an alternattive aspect of the present invention, there is provided a label-dispensing structure comprising a carrier and a face film, said carrier having a release surface, said face film having two faces of which a first contacts said release surface and a second is provided with adhesive, and wherein said release surface is discontinuous, defining at least one discrete label shape and a non-label area, and said face film is a continuous frangible membrane which is not adhesive over substantially the whole of said non-label area.

The invention further provides a method for the manufacture of label-stock comprising on a carrier web having a release surface positively defining at least one label shape, applying a face film over said at least one label shape of said release surface, said face film being adapted to break along the contours of said label shape when a tractive force is applied to the area of said face film substantially corresponding to said at least one label shape; and, if desired, providing adhesive means on the face film and, if desired, indicia.

It will be appreciated that characteristics of any of these aspects of the invention may be applied, in part or in whole, to any other aspect equally.

DESCRIPTION OF PREFERRED EMBODIMENTS

Figure 1:
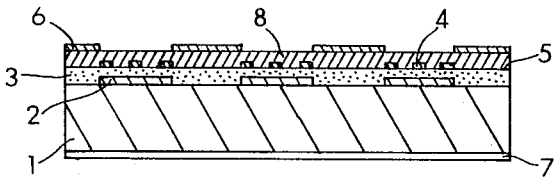
FIG. 1 is a cross-section of a structure according to the invention.

It is preferred that said release surface and said adhesive area substantially correspond to define at least one label-shape.

It is preferred that a further release layer is applied to the back of the carrier web to allow rolling up of the structure, thereby doing away with the need for a further protective layer for the face-stock, although protection may be provided if desired or if, for example, it is desired to store the structure flat.

Print graphics, if required, may be incorporated at any appropriate stage and in as many applications as required.

The term "label-dispensing structure", or "label-stock", means a web upon which at least one label is formed, or is present, and from which the label can be transferred to the article to be labelled by any appropriate means. In general, in order to effect transfer, the structures of the invention will be applied to the article, rather than removing the label prior to application.

The adhesiveness may be a quality of the face film or may be provided as an adhesive layer. If it is a quality of the film, it may, for example, be produced by suitable treatment of the film in the relevant areas; either to deaden the natural adhesiveness or enhance a weak property. In one preferred embodiment, the labelstock is provided with a backing of non-adhesive substance which is made adhesive just prior to use, for example, by irradiation. It is possible for the adhesive area to entirely cover the face film, but this tends to lead to poor definition at the edges of the label. However, in one preferred embodiment, adhesive is used to cover the entire back of the face film and deadener is subsequently applied to render the interstitial areas non-adhesive.

The adhesive area is suitable continuous over the back of the intended label to avoid any possibility of leaving part of the label behind on dispensing. However, it is possible to dot the adhesive area over the back of the label, to save adhesive, for example. In such instances, it will generally be preferred to provide at least the label-outline, alternatively termed the contour line of the label-shape, in continuous adhesive.

Frangibility of the membrane is necessary to allow the label to tear off the web when the adhesive sticks to a substrate, thereby leaving unwanted film still adhering to the areas of the web not having a release surface. It will be apparent that sharp definition of labels is generally preferred, and the structures provided allow labels to be produced which are extremely thin and which can, therefore, be highly frangible. Thus, the strength and continuity of the adhesive layer will usually be the deciding factor as to what of the face film constitutes a label and what is left on the web, although it will readily be appreciated that, while a strong adhesive may be an advantage, it will generally be helpful if the adhesive possesses no great lateral strength, which might interfere with breaking of the film.

Dispensing the labels is preferably by simultaneous contact with the substrate on bending of the web. Thus, it is preferred, at least in this instance, to have a face film which is generally resilient but which is subject to stress-fracturing. As the webbing is bent and the label drawn away, the label fractures at the line of defintion around the release surface, which is the label-outline or contour line of the label-shape.

Use of a continuous film around the label shape ensures that the label is anchored to the web, preventing predispensing or any shift of the face film relative to the web. The structure also provides well-defined labels and considerably enhanced dispensing properties.

In use, the face film fractures at the contour line of the release shapes to form the labels when the object to be labelled is held against the adhesive and pulled away. The film is retained at the interstices, those places on the carrier, or web, between label shapes, where no release surface is present.

The frangible membrane is preferably a thin, plastics layer of a radiation curable polymer described, for example, in EP-A-0 201 100 or EP-A-0 207 257. The membrane should have sufficient strength to hold the label together, during dispensing, but other factors may serve this purpose. More importantly, the membrane should be flexible, to allow winding of the prepared struture, yet allow fracture about the contours of the release shape to provide a well-defined label shape. In some instances, ragged edges may be acceptable, and the present invention includes this possibility but, in general, well-defined labels are preferable.

The polymers disclosed in EP-A-0 201 100 and EP-A-0 207 257 are particularly suitable for use with the present invention, as they possess good adhesive qualities prior to curing. They, thus, adhere to the interstitial area between release surfaces, providing a sharp definition of shape at the boundaries of the release surfaces. The above polymers are also advantageous in that they possess superior dilatent qualities. When bent slowly, they are very flexible, but when subject to high shear forces, they become brittle and fracture easily. For these reasons, these polymers provide a preferred feature of the present invention.

The adhesive may be printed directly on to the label shapes, but it is preferable and generally easier, to cover the entire back of the film with adhesive, an adhesive deadener being provided on non-label areas. This lends further definition to the label shape and represents a preferred embodiment of the present invention.

While it is preferred to provide a ready-for-use, preferably contact, adhesive, such as Evostick (registered Trademark), or such as is described in EP-A-0 201 100, radiation curable adhesives may be provided uncured, to be cured by the end-user.

For storage of the structure, it is possible to provide a protective, release-coated backing to cover the adhesive surfaces when not intended for immediate use. However, it is preferred to provide a continuous release surface on the back of the web, to allow winding of the structure. This surface should be of sufficient releasability not to cause undue predispensing on unwinding of the structure.

The labels of the present invention are typically very thin, and are conformable with the labelled object. These properties also tend to confer a "no-label" aesthetic effect.

The face film of the present invention is preferably a radiation curable polymer as described. Owing to the restraints placed on it by the nature of the labels, it should generally be thin to allow fracture. The thicker the label, the stronger the adhesive necessary. Also, with thicker film, there is a greater chance that the film may pull away from the web all together, or sufficiently to cause a ragged edge.

Given the above considerations, it is preferable that the film be somewhere between about 5 and 100 μm thick, and more preferably between about 10 and 50 μm thick. Further, when the film is radiation curable, too great a thickness may impede curing, or require excessive time to cure.

Labels according to the invention also offer various further advantages as follows. Indicia/print graphics may be protected by encapsulation between adhesive and face film, or in the face film, thus avoiding the problems of scratching and adhesion loss. Conventional dispensing and, usually, die-cutting, are no longer necessary, as the web can be brought directly into contact with the substrate. The invention also allows both very thin labels and conventional caliper products by the use of appropriate coating control and formulation. Very thin, ultra-destructible labels may be used to emulate direct decoration, while thicker labels may be used to provide non-reusable, peelable products.

The inherent flexibility of labels according to the invention also allows compliance with irregular surfaces and deformation with the surface (e.g. squeezable containers) without cracking or creasing. Instead of the usual method of taking the article to the label, the reverse process is possible, which has the advantage of facilitating multi-synchronous labelling. Dispensing of the labels of the invention by contact application also has the advantage that only the area with exposed adhesive is transferred during dispensing.

The structures of this invention can be made with single layers of each material, or can be multi-laminar. Advantageously, for example, the face film is provided by several coatings of a suitable radiation curable polymer. Such polymers offer good resistance to uv light and abrasion.

The adhesive is ideally radiation curable and may also be applied in several layers, as desired. Ideal adhesive are pressure-sensitive. Particularly preferred adhesives are those described in EP-A-0 208 856. It will be appreciated that, where adhesive is applied over the whole surface of the face film, it is desirable for as little fracture impedance as possible to be offered to the face film. Many adhesive are known in the art which provide cohesive layers without offering lateral strength.

Preferably, the exposed adhesive is in register with the release shapes, and defines a slightly larger concentric shape to ensure total cover of the label area.

In general no die cutting is required except when adhesive with very low adhesion levels are employed with ultra-peelable labels, when such a process may be advantageous.

The preferred label release coating is a radiation curable silicone acrylate polymer, although other conventional release coatings may also be used. The coating may be applied, for example, by flexo, gravure, or ink jet to the carrier web in the discrete areas which are to constitute the final label shape. This may then be cured with uv or eb (electron beam) radiation prior to further processing. However, it is preferred to partially cure the coating to set the shape, then overcoat the carrier witht the face film. The two coatings may then be radiation-cured together. This has the advantages of:

(a) excluding oxygen from the silicone acrylate surface, which enables excellent cure without inerting;

(b) allowing the face film to form a partial bond with the release layer, giving rise to a special release between the two, and resulting in transferrence of some silicone to the eventual label, giving an easily-cleaned surface less prone to static attraction of, for example, dust; and (c) the top surface of the face film, which is very slightly undercured through absence of inerting, provides an excellent surface for printing ink adhesion without requiring the special ink additives normally required, or top coatings to ensure adhesion.

A particular advantage of the present invention, in one embodiment, lies in not having to fully cure the release surface before construction of the remainder. It is usual that silicones provided for release surfaces must be fully cured, prior to use, in the absence of oxygen, otherwise their efficacy cannot be guaranteed. In accordance with the present invention, the silicone may be part-cured, even with oxygen present, followed by covering with face film and full-curing. The face film excludes oxygen, and lack of initial full-curing allows some adhesive force to remain between face film and release surface to prevent movement of face film during storage. However, it may be desirable to fully cure the release surface prior to application of the face film, in which case standard release inhibitors may be incorporated in the release surface, such as high boiling point glycols.

The advantage of absence of inerting through this "wet-on-wet" coating approach, as well as the desired effect it gives to the product, make both the process, and the resulting labels, preferred embodiments of the present invention.

The successive ink/indicia applications will usually be effectively applied as reverse images so that the transferred label will read correctly. The adhesive is preferably a pressure-sensitive and radiation-curable polymer, although other types may be used. The adhesive, like the preferred face film, is ideally uv resistant and stable to such as oxidation and solvents, because of the nature of the formulation. This adhesive is applied over the same essential area as the film after the print processes, and cured. Again, the formulation allows for inerting to be avoided, although it may be used if desired.

The adhesive deadening compound may be applied, for example, by flexo, gravure, or ink jet to the interstitial areas around the silicone release coatings. The deadener compound is preferably radiation curable, although other suitable materials, such as talc, and pigmentation in general, and PTFE/resin mixes (such as with acrylic and methylacrylic resins), may be employed. These latter tend only to be of a temporary nature, but may be used in appropriate circumstances.

A preferred reactive diluent is tripropylene glycol diacrylate, a radiation curable deadener. Solvent based deadeners may be used, although these are prone to cross-migrate, and aqueous materials make useable deadeners, although they are less controllable/reliable.

In general, thick layers of deadener or release surface are undesirable, as this tends to lead to labels being defined less sharply. It is preferred that as many materials used as possible be of the same nature, for example radiation-curable, in order to avoid cross-migration of the substances, which may blur the label outline.

In particular, it is advantageous for all materials used (film, deadener, adhesive) to be transparent and thin, thus giving the impression that the label logo has been printed directly onto the product. When the layers are thin, the label also tends to be very resilient, and can withstand multiple re-usage.

A further advantage of the present invention also lies in the low toxicity of the preferred materials.

The release coating on the reverse side of the carrier should have an easier release than, for example, the silicone acrylate of the label release surface. Provided that this criterion is met, the properties of the reverse release surface are not critical and straight winding is not inhibited. The reverse release coating may be of any suitable type.

When uv radiation is used as a curing mechanism, photo initiator(s) will generally be used.

Generally it is preferable that the face film and adhesive are radiation curable liquids which are capable of curing to give materials essentially free of monomers and solvents, yielding films with high flexibility coupled with fracture capability under the appropriate load (force speed).

Preferred macromers for use in accordance with the present invention are radiation curable co-polyesters which contain the acrylate functionality. Suitable examples of preferred types are disclosed in EP-A-0 201 100.

A further preferred embodiment is the co-polyester formulation of the face film plus adhesive, which allows re-cycling on polyester containers.

The polymers referred to herein are not generally available in low viscosity form, so application technique is generally important to control the applied thickness consistently and without damage to the label release layer.

The invention will now be further illustrated with reference to the accompanying drawings.

FIG. 1 essentially illustrates the principle of the invention and shows a web coated on the top side with successive applications of face-film polymer to form the label. The under-surface of the web is provided with a release layer to enable self-winding without label transfer or subsequent misalignment on unwinding. Points of fracture and separation within the area of fracture are also shown.

A carrier web (1) has release surfaces (2) applied in the shape of labels and each supporting a label. Each label is connected by an integral film (3) applied over the whole area of the web (1), and release surfaces (2) define the areas of label release. Indicia/print graphics (4) may be applied to labels as desired. A pressure-sensitive adhesive (5) is applied over the entire surface of the film (3) and an adhesive deadener (6) is applied over those areas in reverse of the release coating (2). The reverse register of deadener (6) to release coating (2) is of importance, and it is preferred that the area defined by release coating (2) is fractionally smaller (but still in register) than that of the deadener compound (6) to ensure adhesive cover over the entire applied label.

The carrier web (1) has a further release coating (7) applied to the entire area of the reverse side, and the relative levels of the release values of coatings (2) and (7) must be such as to allow unwinding of the web to expose "active" adhesive areas without disturbing the register. Adhesion between layer (8) and the substrate must be stronger than that between film (3) and the release surface (2) to allow the label (defined by areas having no deadener (6)) to be dispensed from the web onto the substrate.

Fine definition of the label relies on the fracture of the film (3) at the precise edge of each release surface (2), necessitating balancing the polymeric properties and the relative release forces as between the coating (2) and the film (3) and the adhesive (5).

Figure 2:
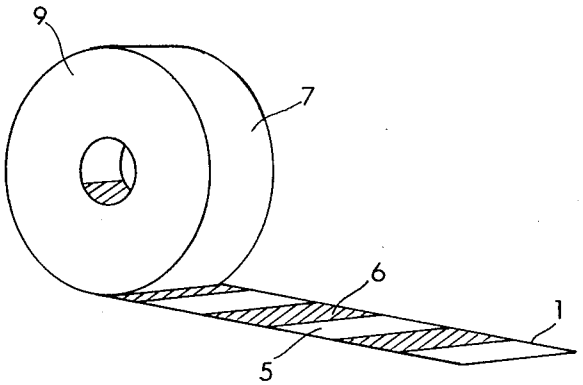
FIG. 2 shows a wound structure of the invention.

In FIG. 2, the roll of labels is partially unwound to show the areas of exposed adhesive ready for application. Unlike laid-on labels, there is no dispensing prior to application, the two processes being combined. The areas of deadened adhesive, with the adhesive film underneath, remain intact during application and contribute reliable register marks.

The roll of labels, under the tension of the winding (9), is shown being unwound, the film (3) and adhesive (5) still being in continuous layers, and separation occurs at the point of application.

Deadening compound (6) ensures that the areas directly beneath it on the carrier web (1) remain unattractive to the substrate and only the exposed adhesive (label) areas are dispensed.

Figure 3:
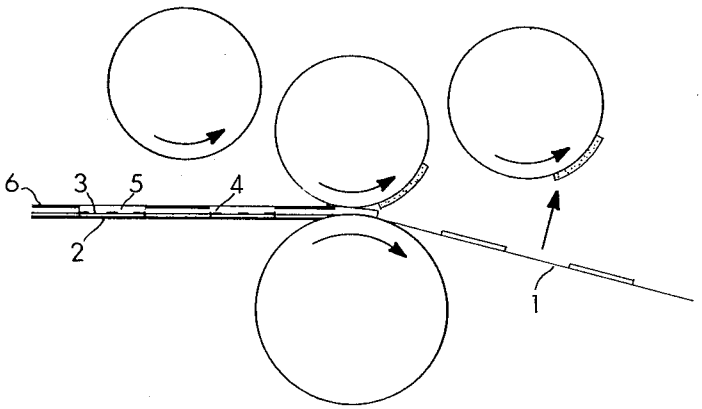
FIG. 3 illustrates a mode of label dispensing.

FIG. 3 shows a method of label application to awkward substrates and the appearance of the label after transferrence.

Figure 4:
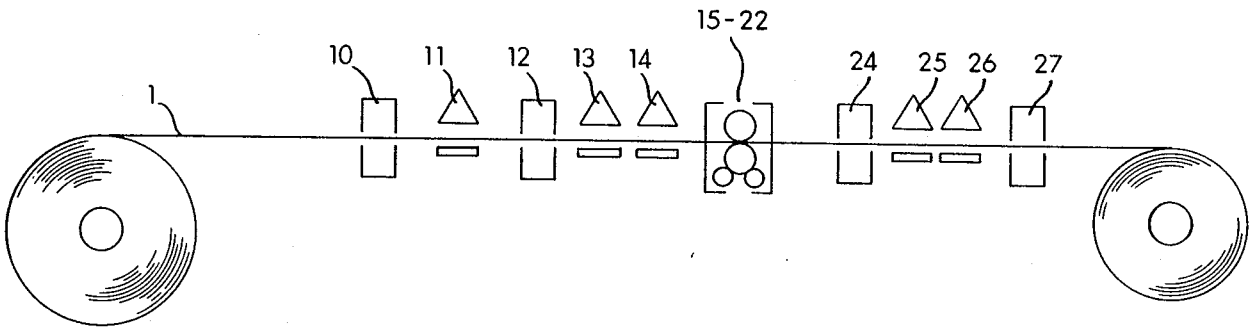
FIG. 4 is a schematic diagram of one mode of manufacture of a structure according to the invention.

In FIG. 4, carrier web (1) is coated with, preferably, silicone acrylate at station (10), and partially cured by radiation source (11). High viscosity face film is applied at (12), and the whole is irradiated at stations (13) and (14) to give full curing and release control. Print indicia are applied in plurality at stations (15)–(22) followed by adhesive deposition at station (24) and radiation curing at stations (25) and (26). Finally, the reverse release layer is applied at station (27) to the reverse side of the carrier (1) to enable self winding without dislodging or transferring the labels in the wound roll.

The following Examples are for the purposes of illustration only and do not serve to limit the scope of the invention.

EXAMPLE 1

Face Film Formulations (A) Dynacoll A 6075 (Trademark) was warm-blended to a homogeneous mixture with 2% Darocur 1173 (Trademark) (2-hydroxy-2,2-dimethyl acetophenone) as photoinitiator at 70°–80° C. Both products are available from Huls AG. The resulting mixture was then further blended with 10% tripropyleneglycol diacrylate (TPGDA) as reactive diluent, prior to UV curing.

(B) A film was made as in (A) above, but using Dynacoll A 6085 (Trademark) in place of Dynacoll A 6075 (Trademark).

The above variations are illustrative of the possibilities available in this particular range of face films.

EXAMPLE 2

Pressure Sensitive Adhesive (PSA) Preparations (A) Dynacoll A 3330 (Trademark) was warm-blended with Darocur 1173 (Trademark) as in Example 1 (A), the remainder of the procedure also being followed, to provide a pressure sensitive adhesive (PSA) after UV curing.

(B) In an alternative, Indamelt HM 440 (Trademark) provided a PSA.

EXAMPLE 3

Deadening Compounds (A) TPGDA (available from BASF, Lankro Chem.).

(B) PTFE (5%) dispersed in 25% methyl methacrylate/ethyl acetate.

EXAMPLE 4

Silicone Release Agents (A) TEGO RC 710 (Trademark) and TEGO RC 720 (Trademark) (Thos Goldschmidt) were blended in a ratio of 1:9 before curing.

(B) Silicolease EP 6608 (Trademark), catalyst EP 6605 and cross-linker EP 6555 (all available from ICI) were blended in the ratio of 96:2:2 prior to cure.

EXAMPLE 5

Glassine-commercially available carrier-(in this case 67 g super-calendered Kraft) was coated on one side with a commercially available release agent to give an "easy" release. The reverse side was printed flexographically which the release agent prepared in Example 4 (A) in discrete label areas. After a partial cure, the whole carrier web, including the discrete areas of silicone, was coated with a 10 μm thick layer of film (Example 1a) by slot orifice. The carrier web was then further extensively irradiated under medium pressure 120 watts/cm mercury lamps. The carrier was approximately 0.75 cm from the lamp and was both air and water cooled. No nitrogen inerting was used for either curing stage. The speed was 30 metres/min. Indicia were then applied to the label face film with uv-curable rotary letterpress inks, and cured as before.

A 10 μm layer of adhesive (Example 2 (A)) was applied by slot orifice to the printed web and was co-extensive with the layer of film previously applied. This was cured as above. Finally, tripropylene glycol diacrylate (deadener) was flexo printed onto the adhesive in the areas not covered by the initial silicone. This application was in register with, but leaving a fractional gap around, the silicone deposition. A final uv cure was performed. The roll was wound and stored for some weeks. When unwound, the exposed adhesive (label) areas were applied to glass bottles. The labels transferred cleanly from the carrier web, giving a thin label (20 microns), simulating direct decoration.

It will be appreciated that many other variations on the invention are possible, and that the invention should only properly be construed in the light of the accompanying claims.

What is claimed is:

1. A label-dispensing structure comprising a carrier web and a face film, said carrier web having a top and reverse side, a release surface being provided on said top side, said face film having two faces, an adhesive-backing being provided on a first of said faces, the second of said faces being mounted against said release surface, wherein said release surface positively defines at least one label-shape and said face film is frangible along the contour line of said at least one label-shape, the area covered by said adhesive-backing corresponding substantially to said at least one label-shape.

2. The structure of claim 1 wherein said release surface and said adhesive area substantially correspond to define at least said one label-shape.

3. The structure of claim 2 wherein said adhesive area marginally overlaps at least said one label-shape.

4. The structure of claim 1 wherein said adhesive-backing is substantially continuous over the area of said film substantially corresponding to at least said one label-shape.

5. The structure of claim 1 wherein said carrier web is provided with a further substantially continuous release surface on said reverse side to permit rolling up of the structure without predispensing said face film.

6. The structure of claim 1 wherein said adhesive-backing is provided by a substance other than said face film.

7. The structure of claim 1 wherein said adhesive-backing is provided as a substantially continuous layer of adhesive deadened in the interstitial areas between said label shapes.

8. The structure of claim 1 wherein said adhesive-backing is provided in the form of a substantially inert substance which can be activated prior to use.

9. The structure of claim 1 wherein said adhesive-backing lacks substantial lateral strength.

10. The structure of claim 1 wherein said face film is stress-fracturable.

11. The structure of claim 1 wherein said face film is between about 5 and 100 μm thick.

12. The structure of claim 1 wherein said face film is between about 10 and 50 um thick.

13. A label-dispersing structure comprising a carrier and a face film, said carrier having a top and reverse side, a release surface being provided on said top side, said face film having two faces of which a first contacts said release surface and a second is provided with adhesive-backing, and wherein said release surface is discontinuous, defining at least one discrete label-shape and a non-label area, and said face film is a continuous member which is frangible along the contour line of said at least one discrete label-shape wherein said face film is not adhesive over substantially the whole of said non-label area.

14. The structure of claim 13 wherein said release surface and said adhesive area substantially correspond to define at least said one label-shape.

15. The structure of claim 14 wherein said adhesive area marginally overlaps at least said one label-shape.

16. The structure of claim 13 wherein said adhesive-backing is substantially continuous over the area of said film substantially corresponding to at least said one label-shape.

17. The structure of claim 13 wherein said carrier web is provided with a further substantially continuous release surface on said reverse side to premit rolling up of the structure without predispensing said face film.

18. The structure of claim 13 wherein said adhesive-backing is provided by a substance other than said face film.

19. The structure of claim 13 wherein said adhesive-backing is provided as a substantially continuous layer of adhesive deadened in the interstitial areas between said label shapes.

20. The structure of claim 13 wherein said adhesive-backing is provided in the form of a substantially inert substance which can be activated prior to use.

21. The structure of claim 13 wherein said adhesive-backing lacks substantial lateral strength.

22. The structure of claim 13 wherein said face film is stress-fracturable.

23. The structure of claim 13 wherein said face film is between about 5 and 100 μm thick.

24. The structure of claim 13 wherein said face film is between about 10 and 50 um thick.

25. A method for the manufacture of label-stock comprising on a carrier web having a release surface positively defining at least one label-shape, applying a face film over said at least one label-shape of said release surface, and said face film being adapted to break along the contour line of said at least one label-shape when a tractive force is applied to the area of said face film substantially corresponding to said at least one label shape.

26. The method of claim 25 further comprising providing adhesive means on said face film.

27. The method of claim 25 further comprising providing indicia on said face film.

28. The method of claim 25 wherein said face film is applied as a radiation curable substance.

29. The method of claim 26 wherein said adhesive means is applied as a radiation curable substance.

30. The method of claim 25 wherein said release surface is applied as a radiation curable substance.

31. The method of claim 25 wherein said release surface and said face film are applied as radiation curable substances, said release surface being at least partially cured before said face film is applied.

32. The method of claim 29 wherein said release surface is silicone.

* * * * *